US007471263B2

(12) United States Patent
Lee et al.

(10) Patent No.: US 7,471,263 B2
(45) Date of Patent: Dec. 30, 2008

(54) APPARATUS AND METHOD FOR DRIVING PLASMA DISPLAY PANEL

(75) Inventors: Jun Hak Lee, Suwon-si (KR); Jeong Pil Choi, Suwon-si (KR); Seong Hee Park, Seoul (KR)

(73) Assignee: LG Electronics Inc., Seoul (KR)

( * ) Notice: Subject to any disclaimer, the term of this patent is extended or adjusted under 35 U.S.C. 154(b) by 781 days.

(21) Appl. No.: 11/008,674

(22) Filed: Dec. 10, 2004

(65) Prior Publication Data

US 2005/0140582 A1 Jun. 30, 2005

(30) Foreign Application Priority Data

Dec. 15, 2003 (KR) ..... 10-2003-0091150

(51) Int. Cl.
*G09G 3/28* (2006.01)

(52) U.S. Cl. ..... 345/60

(58) Field of Classification Search ..... 345/60–72, 345/204, 596, 690; 315/169.4
See application file for complete search history.

(56) References Cited

U.S. PATENT DOCUMENTS 5,805,738 A * 9/1998 Kaburagi et al. ..... 382/251
6,104,362 A * 8/2000 Kuriyama et al. ..... 345/63
6,175,194 B1 * 1/2001 Saegusa et al. ..... 315/169.4
6,414,658 B1 * 7/2002 Tokunaga ..... 345/63
6,417,824 B1 * 7/2002 Tokunaga et al. ..... 345/60
6,476,824 B1 * 11/2002 Suzuki et al. ..... 345/690
6,483,248 B2 * 11/2002 Nagakubo et al. ..... 315/169.3
6,495,968 B2 * 12/2002 Tokunaga ..... 315/169.4
6,614,413 B2 * 9/2003 Tokunaga et al. ..... 345/63
6,646,625 B1 * 11/2003 Shigeta et al. ..... 345/63
6,831,618 B1 * 12/2004 Suzuki et al. ..... 345/60
6,906,726 B2 * 6/2005 Suzuki ..... 345/596
6,967,636 B2 * 11/2005 Shigeta et al. ..... 345/63
6,985,141 B2 * 1/2006 Abe et al. ..... 345/204
7,042,424 B2 * 5/2006 Shigeta et al. ..... 345/63
7,071,902 B1 * 7/2006 Kawahara ..... 345/63
7,126,563 B2 * 10/2006 Lin et al. ..... 345/63
7,154,457 B2 * 12/2006 Sagano et al. ..... 345/78
7,203,376 B2 * 4/2007 Takahashi et al. ..... 382/252
7,256,794 B2 * 8/2007 Myoung et al. ..... 345/596

(Continued)

*Primary Examiner*—Sumati Lefkowitz
*Assistant Examiner*—Rodney Amadiz
(74) *Attorney, Agent, or Firm*—KED & Associates, LLP

(57) ABSTRACT

Disclosed herein is an apparatus for driving a plasma display panel in which a gray scale inversion phenomenon can be prevented. According to the present invention, the apparatus for driving the PDP includes an error diffusion unit for diffusing error of data received from an inverse gamma correction unit, a gray scale inversion check unit connected to the inverse gamma correction unit, for checking whether a gray scale value of the data received from the inverse gamma correction unit is a gray scale value where a gray scale inversion phenomenon is generated, and generating a 1-bit control signal according to the check result, an adder disposed between the error diffusion unit and the gray scale inversion check unit, for adding the 1-bit control signal to lower bits of the data received from the error diffusion unit, and a dithering unit for performing dithering by using the lower bits received from the adder. Therefore, when dithering is performed on data where gray scale inversion is generated, a gray scale value can be improved by adding 1 to lowest bits of the data. It is thus possible to prevent the gray scale inversion phenomenon.

7 Claims, 7 Drawing Sheets

U.S. PATENT DOCUMENTS

| | | | | |
|---|---|---|---|---|
| 7,292,236 | B2 * | 11/2007 | Abe et al. | 345/204 |
| 2002/0180754 | A1 * | 12/2002 | Suzuki | 345/598 |
| 2003/0011545 | A1 * | 1/2003 | Sagano et al. | 345/76 |
| 2005/0110714 | A1 * | 5/2005 | Lee | 345/63 |
| 2005/0140584 | A1 * | 6/2005 | Kim et al. | 345/60 |
| 2005/0248583 | A1 * | 11/2005 | Gotoda | 345/596 |
| 2006/0017744 | A1 * | 1/2006 | Yamada | 345/596 |
| 2006/0066643 | A1 * | 3/2006 | Arai et al. | 345/690 |
| 2006/0214887 | A1 * | 9/2006 | Ishida et al. | 345/63 |
| 2006/0256142 | A1 * | 11/2006 | Sagano et al. | 345/690 |

* cited by examiner

| Integer part | Fraction part |
|---|---|
| X X X X X X X X | X X X X X X X X |
| X X X X X X X X | X X X X X X X X |
| ⋮ | ⋮ |
| X X X X X X X X | X X X X X X X X |

APPARATUS AND METHOD FOR DRIVING PLASMA DISPLAY PANEL

This Nonprovisional application claims priority under 35 U.S.C. § 119(a) on Patent Application No. 10-2003-0091150 filed in Korea on Dec. 15, 2003, the entire contents of which are hereby incorporated by reference.

BACKGROUND OF THE INVENTION

1. Field of the Invention

The present invention relates to an apparatus and method for driving a plasma display panel, and more particularly, to an apparatus and method for driving a plasma display panel in which a gray scale inversion phenomenon can be prevented.

2. Description of the Background Art

A plasma display panel (hereinafter, referred to as PDP) is a display device that employs the principle that a visible ray is generated from phosphors when the phosphors are excited with a vacuum ultraviolet generated upon discharge of a gas. The PDP is advantageous in that it is thin in thickness and light in weight and can be made large with high definition, compared to a cathode ray tube (CRT) that has become the main stream of a display means so far. The PDP is composed of a number of discharge cells arranged in a matrix shape, and one of the discharge cells constitutes one pixel.

FIG. 1 is a perspective view illustrating the structure of a discharge cell of a conventional three-electrode AC surface discharge type PDP.

Referring to FIG. 1, the discharge cell of the conventional three-electrode AC surface discharge type PDP includes a scan electrode 12Y and a sustain electrode 12Z both of which are formed on the bottom surface of an upper substrate 10, and an address electrode 20X formed on the top surface of a lower substrate 18.

An upper dielectric layer 14 and a protection film 16 are laminated on the upper substrate 10 in which the scan electrode 12Y and the sustain electrode 12Z are formed parallel to each other. Wall charges generated upon plasma discharge are accumulated on the upper dielectric layer 14. The protection film 16 serves to prevent damage of the upper dielectric layer 14 due to sputtering generated upon the plasma discharge, and improve efficiency of secondary electron emission. Magnesium oxide (MgO) is typically used as the protective layer 16.

A lower dielectric layer 22 and barrier ribs 24 are sequentially formed on the lower substrate 18 in which the address electrode 20X is formed. A phosphor layer 26 is coated on the lower dielectric layer 22 and the barrier ribs 24. The address electrode 20X is formed in a direction in which the address electrode 20X cross the scan electrode 12Y and the sustain electrode 12Z.

The barrier ribs 24 are formed parallel to the address electrode 20X, and serve to prevent ultraviolet and a visible ray generated by a gas discharge from leaking toward neighboring discharge cells. The phosphor layer 26 is light-emitted by ultraviolet generated upon plasma discharge to generate one of red, green and blue visible rays. An inert gas for the gas discharge is injected into discharge spaces defined between the upper substrate 10 and the barrier ribs 24 and between the lower substrate 18 and the barrier ribs 24.

This PDP is driven with one frame being divided into several sub-fields having a different number of discharges in order to represent the gray scale of an image. Each of the sub fields is subdivided into a reset period for generating a uniform discharge, an address period for selecting a discharge cell, and a sustain period in which the gray scale is represented depending on the number of a discharge.

For example, if it is desired to represent an image with 256 gray scales, a frame period (16.67 ms) corresponding to 1/60 seconds is divided into eight sub-fields SF1 to SF8, as shown in FIG. 2. Furthermore, each of the eight sub-fields SF1 to SF8 is subdivided into the reset period, the address period and the sustain period. In this time, the reset period and the address period of each of the sub-fields are the same every sub-field, but the sustain period of each of the sub-fields increases in the ratio of 2n (n=0, 1, 2, 3, 4, 5, 6, 7) in each sub-field.

FIG. 3 is a waveform shown to explain a method of driving the conventional three-electrode AC surface discharge type PDP.

Referring to FIG. 3, one sub-field is divided into a reset period where the whole screen is initialized, an address period where data is written while scanning the whole screen in the progressive scan mode, and a sustain period where cells into which data is written keep light-emitted.

In the reset period, a reset waveform RP is applied to scan electrode lines Y1 to Ym at the same time. If the reset waveform RP is applied to the scan electrode lines Y1 to Ym, a reset discharge is generated between the scan electrode lines Y1 to Ym and sustain electrode lines Z1 to Zm, so that discharge cells are initialized.

In the address period, a scan pulse SP is sequentially applied to the scan electrode lines Y1 to Ym. A data pulse Dp, which is synchronized to the scan pulse SP, is applied to the address electrode lines X1 to Xn. In this time, an address discharge is generated in discharge cells to which the data pulse Dp and the scan pulse SP are applied.

In the sustain period, first and second sustain pulses SUSPy, SUSPz are alternately applied to the scan electrode lines Y1 to Ym and sustain electrode lines Z1 to Zm. In this time, a sustain discharge is generated in discharge cells in which the address discharge is generated.

In this PDP, the brightness is determined according to the following Equation 1.

$$B_{graylevel} = \text{gain} \sum_{i=1}^{k} A_i N_i s \tag{1}$$

In the above equation, B is the brightness, A is sub-field mapping information, k is the number of a sub-field, N is sub-field weight, and s is once discharge brightness of a sustain pulse.

Furthermore, gain is obtained by using the ratio of the sustain number to the number of the gray scale. In other words, gain=a total number of sustain/(gray scale level 1). For example, if a total number of sustain is 255 and a total number of the gray scale is 256, gain is set to "1".

The sub-field mapping information A indicates selecting information of an address period. For example, if a discharge cell is selected in the address period, A is set to "1". If a discharge cell is not selected in the address period, A is set to "0". N indicates a weight of a sub-field corresponding to the current number of a sub-field k. s designates the brightness generated by once sustain discharge.

For example, if gain is set to 1, twelve sub-fields exist, and weights of the sub-fields are respectively set to 1, 2, 4, 8, 16, 32, 32, 32, 32, 32, 32 and 32 in a PDP, the brightness of the PDP can be set as in Table 1.

TABLE 1

| Gray Scale | Weight of sub-fields 1 | 2 | 4 | 8 | 16 | 32 | 32 | 32 | 32 | 32 | 32 | 32 | Brightness |
|---|---|---|---|---|---|---|---|---|---|---|---|---|---|
| 0 | X | X | X | X | X | X | X | X | X | X | X | X | 0S |
| 1 | ○ | X | X | X | X | X | X | X | X | X | X | X | 1S |
| 2 | X | ○ | X | X | X | X | X | X | X | X | X | X | 2S |
| ... | | | | | | ... | | | | | | | ... |
| 31 | ○ | ○ | ○ | ○ | ○ | X | X | X | X | X | X | X | 31S |
| 32 | X | X | X | X | X | ○ | X | X | X | X | X | X | 32S |
| ... | | | | | | ... | | | | | | | ... |
| 255 | ○ | ○ | ○ | ○ | ○ | ○ | ○ | ○ | ○ | ○ | ○ | ○ | 255S |

In Table 1, "X" means that the gray scales are not represented, and "O" means that the gray scales are represented. As can be seen from Table 1, the PDP includes the twelve sub-fields, and represents 256 gray scales by using 1, 2, 4, 8, 16, 32, 32, 32, 32, 32 and 32 brightness weights.

Table 1 shows the brightness of the PDP in consideration of only light generated by the sustain discharge. In a PDP that is actually driven, however, light is generated by the reset discharge and the address discharge as well as the sustain discharge. As such, if the gray scales are represented inclusive of the reset discharge, the address discharge and the sustain discharge, a gray scale inversion phenomenon occurs, as shown in FIG. 4. In other words, there occurs a case where the brightness of a PDP represented in a n (n is a natural number)−1 gray scale is set to be brighter than those represented in a n gray scale.

This will be described in more detail. As can be seen from Table 1, in order to represent the 31 gray scales, the sub-fields having the 1, 2, 4, 8 and 16 brightness weights have to be selected. Therefore, in order to represent the 31 gray scales, an address discharge is generated in the five sub-fields. On the contrary, in order to represent the 32 gray scales, the sub-field having the 32 brightness weight must be selected. Accordingly, in order to represent the 32 gray scales, the address discharge is generated in the one sub-field. In this time, a brightness inversion phenomenon is generated because of the light generated by the address discharge between the 31 gray scale and the 32 gray scale. In other words, the 31 gray scale generates light, which is brighter than that generated by the 32 gray scale.

In reality, the brightness of a PDP including light generated in the reset discharge and the address discharge can be determined by the following Equation 2.

$$B_{graylevel}(r, a, s) = LSr + \sum_{i=1}^{k} A_i Sa + \text{gainS} \sum_{i=1}^{k} A_i SN_i Ss \tag{2}$$

In this equation, L is the number of sub-fields that are initially reset, r is once discharge brightness of a reset pulse, and a is once discharge brightness of an address pulse.

L indicates the number of sub-fields in which a reset discharge is generated. For example, if twelve sub-fields exist and the reset discharge is generated in the twelve sub-fields in a PDP, L can be set to 12.

A matrix of Equation 3 can be induced from Equation 2.

$$\begin{bmatrix} 8 & 12 & 0 & 0 & 9 \\ 12 & 1 & 1 & & \\ \cdots & \cdots & \cdots & & \\ 12 & 12 & 255 & & \end{bmatrix} \begin{bmatrix} 8 \\ r \\ 9 \\ a \\ s \end{bmatrix} = \begin{bmatrix} 8 \\ 0.9487 \\ 2.275625 \\ \cdots \\ 124.85 \end{bmatrix} \tag{3}$$

Meanwhile, in the conventional PDP, in order to stabilize the sustain discharge in the sustain period, a pair of sustain pulse is additionally applied to each sub-field.

The brightness including light generated by the pair of the sustain pulses can be determined by the following Equation 4.

$$B_{graylevel}(r, a, s) = LSr + \sum_{i=1}^{k} A_i Sa + \text{gainS} \sum_{i=1}^{k} A_i SN_i Ss + \sum_{i=1}^{k} A_i Ss \tag{4}$$

A matrix such as Equation 3 is induced from Equation 4. The values r, a, s can be found by using the matrix. Usually, the value r (once discharge brightness of the reset pulse) is 0.208815[cd/m$^2$], a (once discharge brightness of the address pulse) is 0.413396[cd/m$^2$], and s (once discharge brightness of the sustain pulse) is 0.44553[cd/m$^2$]. In this time, the values r, a and s are not actual brightness, but are values calculated using the equation. The brightness similar to actual brightness can be obtained by substituting the values r, a and s.

The brightness of the PDP, which includes the discharge brightness of the reset pulse, the discharge brightness of the address pulse and the discharge brightness of the sustain pulse, i.e., the brightness of the PDP by Equation 4 can be expressed into the following Table 2.

TABLE 2

| Gray Scale | Weight of Sub-Field 1 | 2 | 4 | 8 | 16 | 32 | 32 | 32 | 32 | 32 | 32 | 32 | Brightness |
|---|---|---|---|---|---|---|---|---|---|---|---|---|---|
| 0 | X | X | X | X | X | X | X | X | X | X | X | X | 12r + 0a + 0s + 0s |
| 1 | ○ | X | X | X | X | X | X | X | X | X | X | X | 12r + 1a + 1s + 1s |
| 2 | X | ○ | X | X | X | X | X | X | X | X | X | X | 12r + 1a + 2s + 1s |
| ... | | | | | | ... | | | | | | | ... |
| 31 | ○ | ○ | ○ | ○ | ○ | X | X | X | X | X | X | X | 12r + 5a + 31s + 5s |
| 32 | X | X | X | X | X | ○ | X | X | X | X | X | X | 12r + 1a + 32s + 1s |
| ... | | | | | | ... | | | | | | | ... |
| 255 | ○ | ○ | ○ | ○ | ○ | ○ | ○ | ○ | ○ | ○ | ○ | ○ | 12r + 12a + 255s + 12s |

In Table 2, in the gray scale of 0, only the brightness of a reset pulse, which is generated in 12 sub-fields, is represented. In the gray scale of 1, the sustain brightness corresponding to the brightness weight of 1, the brightness by a pair of sustain pulses, the brightness by 12 reset pulses, and the brightness by one address discharge are represented. Furthermore, in the gray scale of 31, the sustain brightness corresponding to the 31 brightness weight, the brightness by five sustain pulse pairs, the brightness by 12 reset pulses, and the brightness by five address discharges are represented. Moreover, in the gray scale of 32, the sustain brightness corresponding to the brightness weight of 32, the brightness by one sustain pulse pair, the brightness by 12 reset pulses, and the brightness by one address discharge are represented.

In this time, if the values r, a and s are substituted in the gray scale of 31, the brightness of "20.61184" is represented in the PDP. Furthermore, if the values r, a and s are substituted in the gray scale of 32, the brightness of "17.62166" is represented in the PDP. That is, in the conventional PDP, the gray scale inversion phenomenon is generated and an image having a linear brightness cannot be represented accordingly.

SUMMARY OF THE INVENTION

Accordingly, the present invention has been made in view of the above problems, and it is an object of the present invention to provide an apparatus and method for driving a plasma display panel in which a gray scale inversion phenomenon can be prevented.

To achieve the above object, according to the present invention, there is provided an apparatus for driving a plasma display pane, including: an error diffusion unit for diffusing error of data received from an inverse gamma correction unit, a gray scale inversion check unit connected to the inverse gamma correction unit, for checking whether a gray scale value of the data received from the inverse gamma correction unit is a gray scale value where a gray scale inversion phenomenon is generated, and generating a 1-bit control signal according to the check result, an adder disposed between the error diffusion unit and the gray scale inversion check unit, for adding the 1-bit control signal to lower bits of the data received from the error diffusion unit, and a dithering unit for performing dithering by using the lower bits received from the adder.

The gray scale inversion check unit comprises a memory in which gray scale values where the gray scale inversion phenomenon is generated are previously stored.

The gray scale inversion check unit generates the 1-bit control signal of "1" when data having a gray scale value where the gray scale inversion phenomenon is generated is received, and generates the 1-bit control signal of 0 when data having a gray scale value where the gray scale inversion phenomenon is not generated is received.

The apparatus further includes a compare unit disposed between the error diffusion unit and the adder, wherein the compare unit supplies lower bits received from the error diffusion unit to the dithering unit when the lower bits are all "1", and supplies the lower bits to the dithering unit when the lower bits are not "1".

According to the present invention, there is provided a method of driving a plasma display panel, including the steps of: diffusing error of data which is currently being received, checking whether a gray scale value of the data which is currently being received is a gray scale value where a gray scale inversion phenomenon is generated, and generating a 1-bit control signal according to the check result, adding the 1-bit control signal to lower bits of the error diffused data, and performing dithering by using the lower bits to which the 1-bit control signal is added.

The step of generating the 1-bit control signal comprises generating the 1-bit control signal of 1 when the gray scale value of the data is the gray scale value where the gray scale inversion phenomenon is generated, and generating the 1-bit control signal of 0 when the gray scale value of the data is a gray scale value where the gray scale inversion phenomenon is not generated.

When the lower bits of the error diffused data are all "1", the dithering is performed without adding the 1-bit control signal.

BRIEF DESCRIPTION OF THE DRAWINGS

Further objects and advantages of the invention can be more fully understood from the following detailed description taken in conjunction with the accompanying drawings in which.

DETAILED DESCRIPTION OF PREFERRED EMBODIMENTS

Preferred embodiments of the present invention will be described in a more detailed manner with reference to FIGS. 5 to 9.

Figure 1:
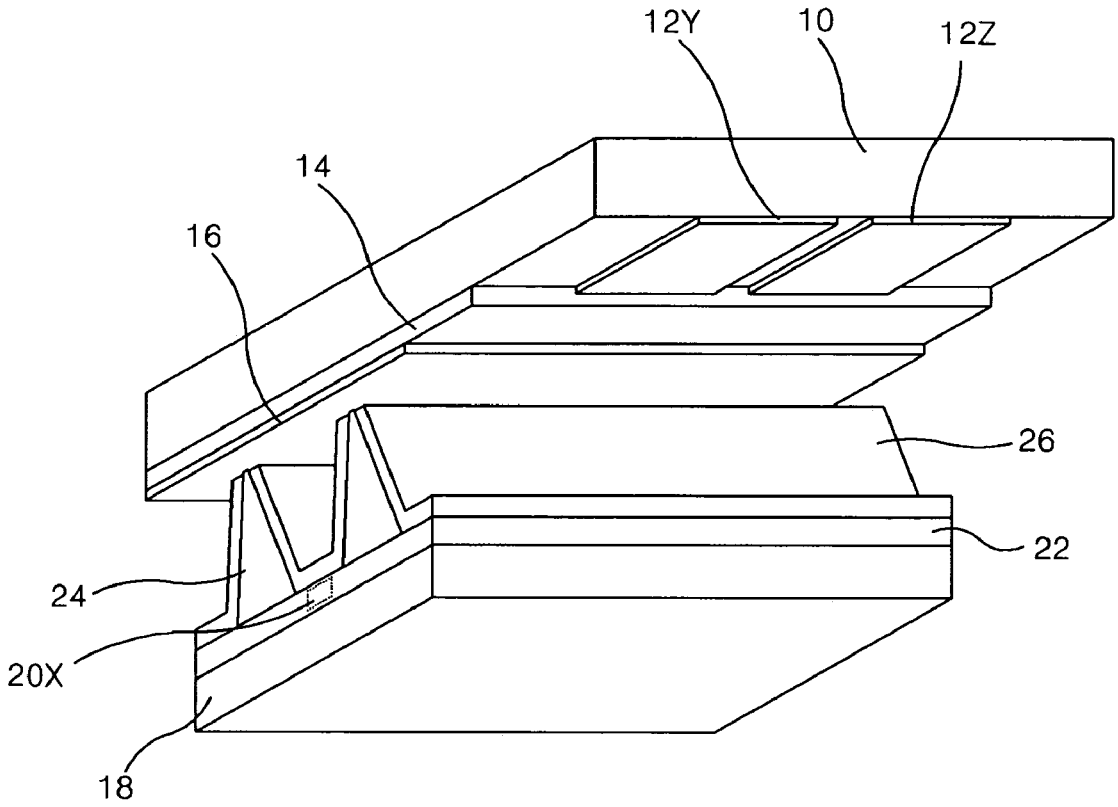
FIG. 1 is a perspective view illustrating the structure of a discharge cell of a conventional three-electrode AC surface discharge type PDP.
Figure 2:
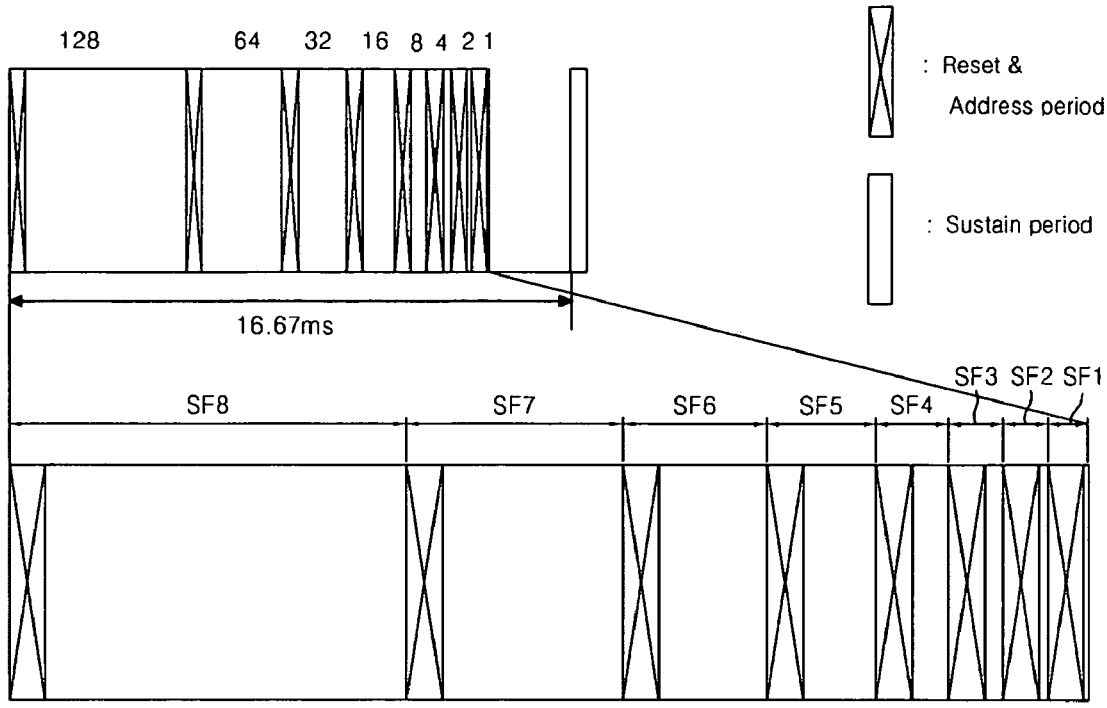
FIG. 2 is a view illustrating a plurality of sub-fields included in one frame of the PDP.
Figure 3:
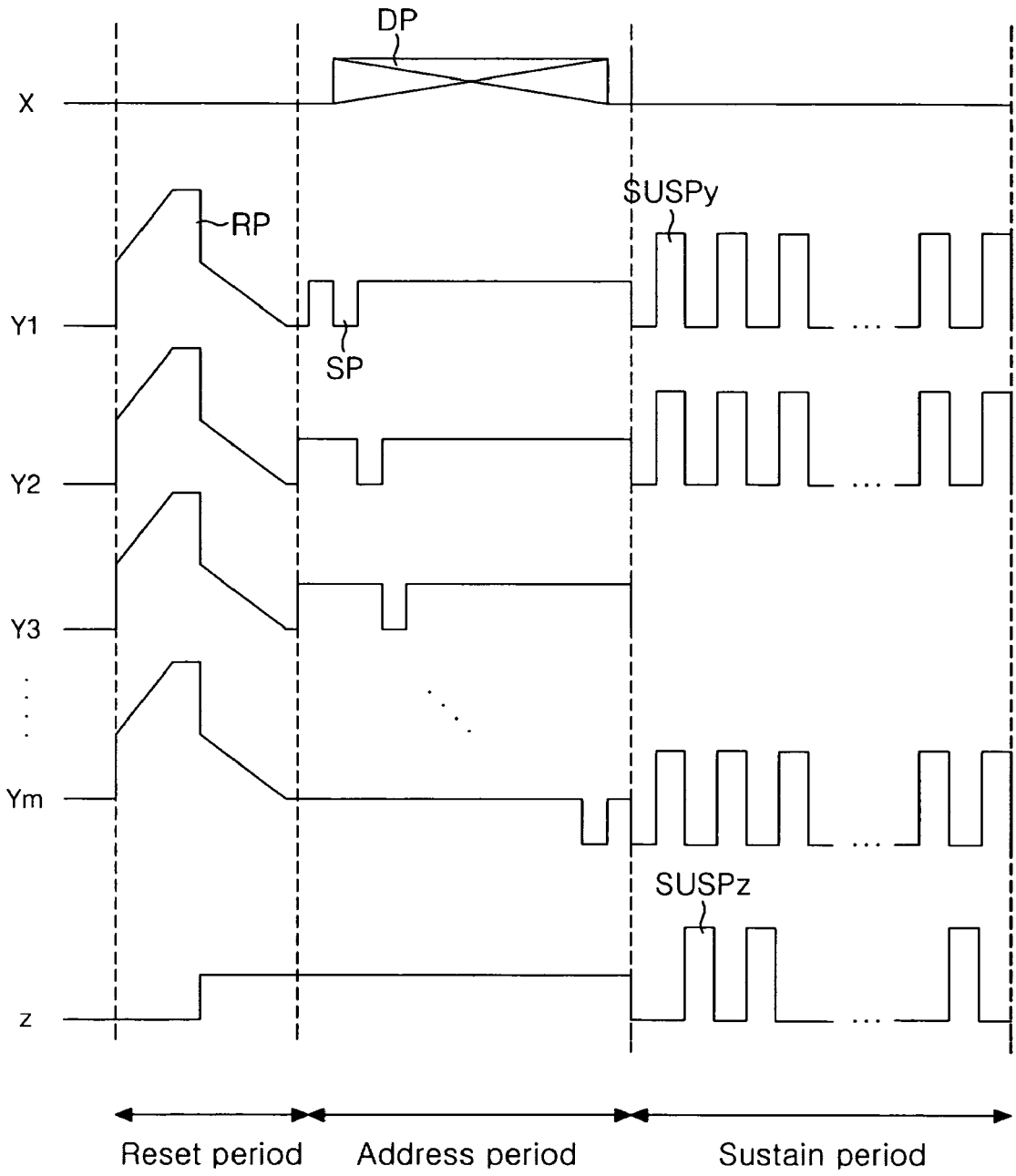
FIG. 3 shows a driving waveform that is supplied to electrodes in sub-field periods shown in FIG. 2.
Figure 4:
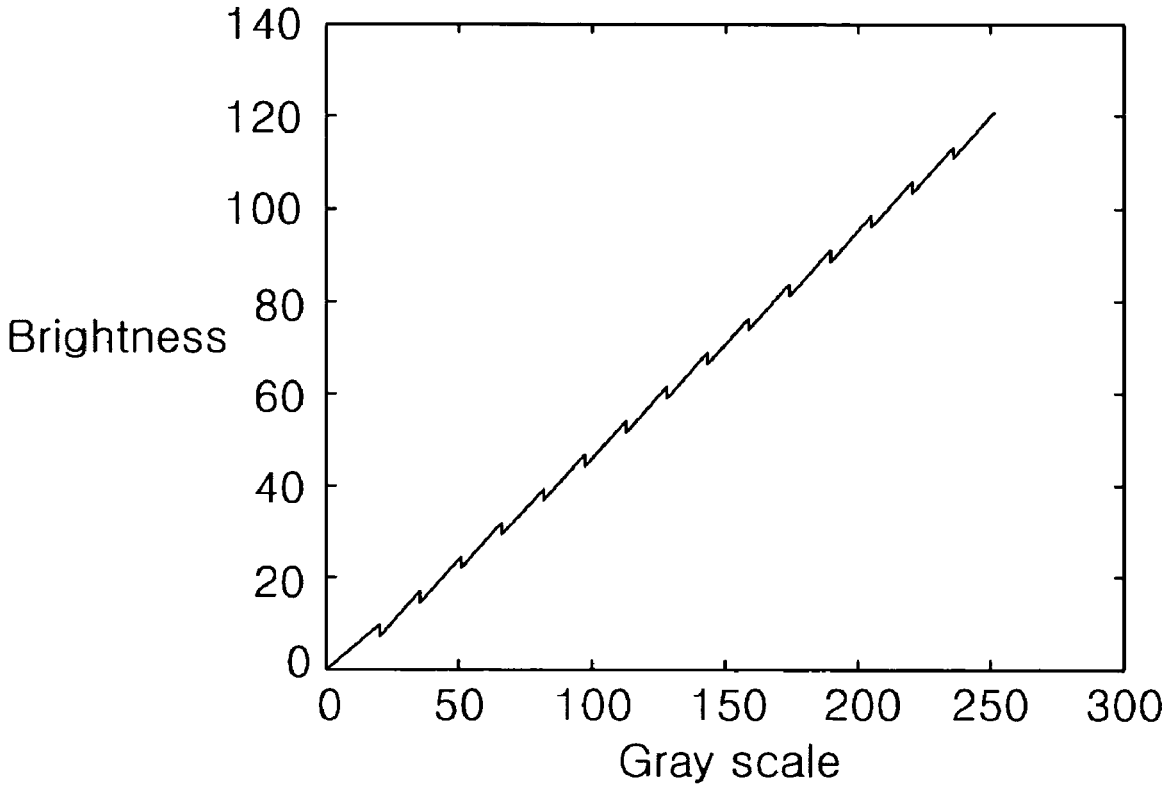
FIG. 4 is a graph for explaining the gray scale inversion phenomenon of a conventional PDP.
Figures 5, 6:
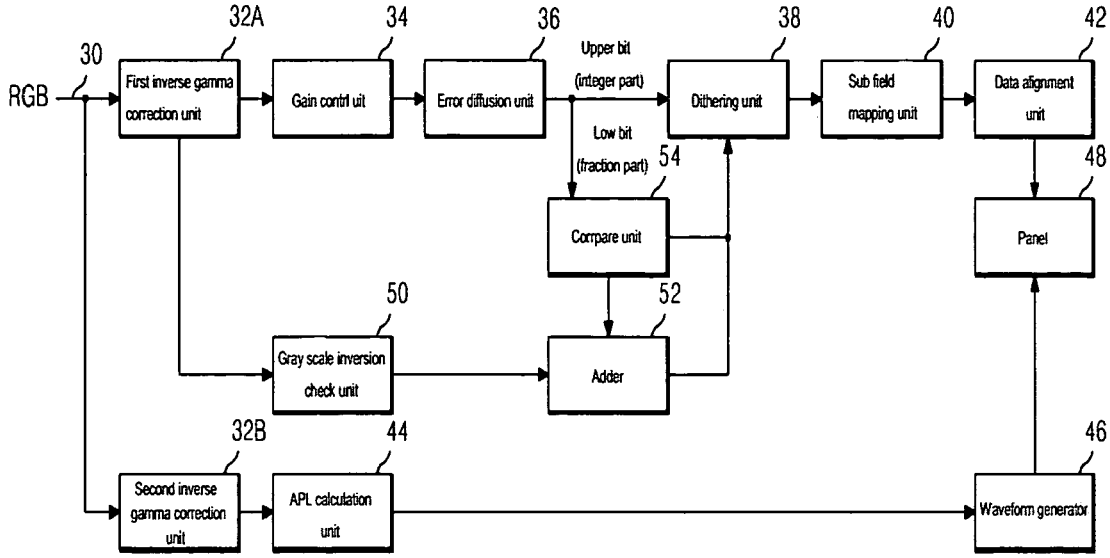
FIG. 5 is a block diagram illustrating an apparatus for driving a PDP according to an embodiment of the present invention.
FIG. 6 illustrates an output format of the inverse gamma correction unit shown in FIG. 5.

FIG. 5 is a block diagram illustrating an apparatus for driving a PDP according to an embodiment of the present invention.

Referring to FIG. 5, the apparatus for driving the PDP according to the present invention includes a gain control unit 34, an error diffusion unit 36, a dithering unit 38 and a sub-field mapping unit 40 all of which are connected between a first inverse gamma correction unit 32A and a data alignment unit 42, an APL (Average Picture Level) calculation unit 44 connected between a second inverse gamma correction unit 32B and a waveform generator 46, a gray scale inversion check unit 50 and an adder 52 both of which are connected between the first inverse gamma correction unit 32A and the dithering unit 38, and a compare unit 54 connected between the error diffusion unit 36 and the adder 52.

The first and second inverse gamma correction units 32A, 32B perform an inverse gamma correction process on digital video data RGB received from an input line 30, thus linearly converting the brightness for a gray scale value of a picture signal.

The gain control unit 34 controls an effective gain by the red, green and blue data, thus compensating for color temperature.

The sub-field mapping unit 40 maps data received from the dithering unit 38 to sub-field patterns stored therein, on a per bit basis, and supplies the mapping data to the data alignment unit 42.

The data alignment unit 42 supplies the digital video data, which is received from the sub-field mapping unit 40, to a data driving circuit of a panel 48. The data driving circuit is connected to data electrodes of the panel 48, and it latches the data received from the data alignment unit 42 by 1 horizontal line and supplies the latched data to the address electrodes of the panel 48 in a 1 horizontal period unit.

The APL calculation unit 44 calculates an average brightness, i.e., APL in one screen unit for the digital video data RGB, which is received from the second inverse gamma correction unit 32B, and then outputs information on the number of sustain pulses corresponding to the calculated APL.

The waveform generator 46 generates a timing control signal in response to the information on the number of the sustain pulses from the APL calculation unit 44, and supplies the timing control signal to a scan driving circuit and a sustain driving circuit (not shown). The scan driving circuit and the sustain driving circuit supply sustain pulses to the scan electrodes and the sustain electrodes of the panel 48 during the sustain period, in response to the timing control signal received from the waveform generator 46.

The error diffusion unit 36 finely controls the brightness value by diffusing error of the digital video data RGB received from the gain control unit 34 to neighboring cells.

The gray scale inversion check unit 50 checks whether a gray scale inversion phenomenon is generated in a gray scale value of data, which is currently being received. The dithering unit 38 finely controls the brightness value of the gray scale by using a dither mask pattern. Also, the dithering unit 38 controls the brightness value of the gray scale so that the gray scale inversion phenomenon is not generated through control of the gray scale inversion check unit 50 (Actually, the brightness value of the gray scale is adjusted by 1 of 1 bit added in the adder 52). That is, according to the present invention, the dithering unit 38 controls a brightness value of a gray scale where a gray scale inversion phenomenon is generated, thus preventing the gray scale inversion phenomenon from occurring.

This will be described in more detail. Video data outputted from the first inverse gamma correction unit 32A is classified into an integer part and a fraction part, as shown in FIG. 6. (In FIG. 6, reference character X is "1" or "0") For example, if i-bit (i is a natural number) video data is received from the outside, the first inverse gamma correction unit 32A outputs corrected video data having 8-bit integer parts and 8-bit fraction parts so that the brightness for a gray scale value can be linearly converted.

The video data outputted from the first inverse gamma correction unit 32A is provided to the error diffusion unit 36 via the gain control unit 34, and the gray scale inversion check unit 50.

Figure 7:
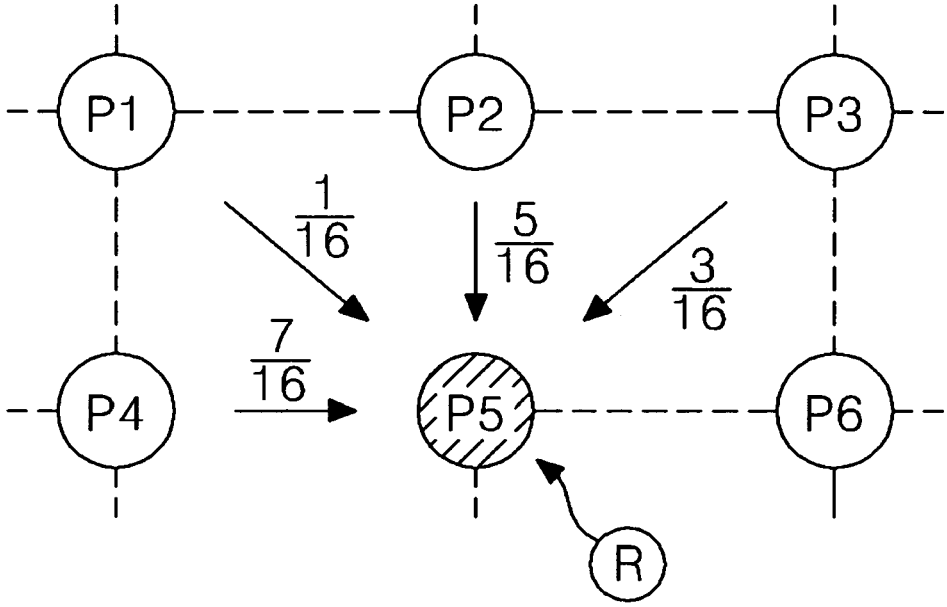
FIG. 7 is a diagram illustrating an operating procedure of the error diffusion unit shown in FIG. 5.

The error diffusion unit 36 performs an error diffusion operation on the received video data. For example, the error diffusion unit 36 can perform the error diffusion operation by using weights 1/16, 5/16, 3/16 and 7/16, as shown in FIG. 7. In other words, the error diffusion unit 36 performs the error diffusion operation by assigning the weight of 1/16 to a fraction part of a P1 pixel, the weight of 5/16 to a fraction part of a P2 pixel, the weight of 3/16 to a fraction part of a P3 pixel and the weight of 7/16 to a fraction part of a P4 pixel. Furthermore, the error diffusion unit 36 employs a random coefficient R in the error diffusion operation in order to prevent an error diffusion pattern from occurring. The error diffusion unit 36 carries out the error diffusion operation by using some bits of the fraction part of the video data inputted thereto, for example, lower 5 bits.

The gray scale inversion check unit 50 checks whether a gray scale value of the data received from the first inverse gamma correction unit 32A is a gray scale where a gray scale inversion phenomenon is generated. In the concrete, the gray scale inversion check unit 50 first receives data from the first inverse gamma correction unit 32A. The gray scale inversion check unit 50 then checks whether the gray scale inputted thereto is a gray scale where a gray scale inversion phenomenon is generated. For this, the gray scale inversion check unit 50 includes a memory (not shown). The memory stores gray scales (for example, 32 gray scale) in which the gray scale inversion phenomenon is generated. (Actually, gray scales where gray scale inversion is generated are stored in the memory).

Therefore, the gray scale inversion check unit 50 checks whether the gray scale inversion phenomenon is generated in a gray scale value of data, which is currently being received, by comparing the received gray scale value and the gray scale value stored in the memory. In this time, if the gray scale inversion phenomenon is generated, the gray scale inversion check unit 50 supplies 1 to the adder 52. If the gray scale inversion phenomenon is not generated, the gray scale inversion check unit 50 supplies 0 to the adder 52.

The adder 52 adds lower bits (e.g., decimal 3 bits) of the data received from the error diffusion unit 36 and 1 bit received from the gray scale inversion check unit 50. For example, if lower bits of "010" are inputted to the error diffusion unit 36 and "1" is inputted to the gray scale inversion check unit 50, the adder 52 supplies "011" to the dithering unit 38. Meanwhile, if the lower bits are "111", the compare unit 54 is disposed in front of the adder 52 so that 1 bit inputted to the gray scale inversion check unit 50 is not added. The compare unit 54 disposed between the error diffusion unit 36 and the adder 52 supplies the lower bits of "111" to the dithering unit 38, and supplies the remaining bits to the adder 52.

Figure 8:
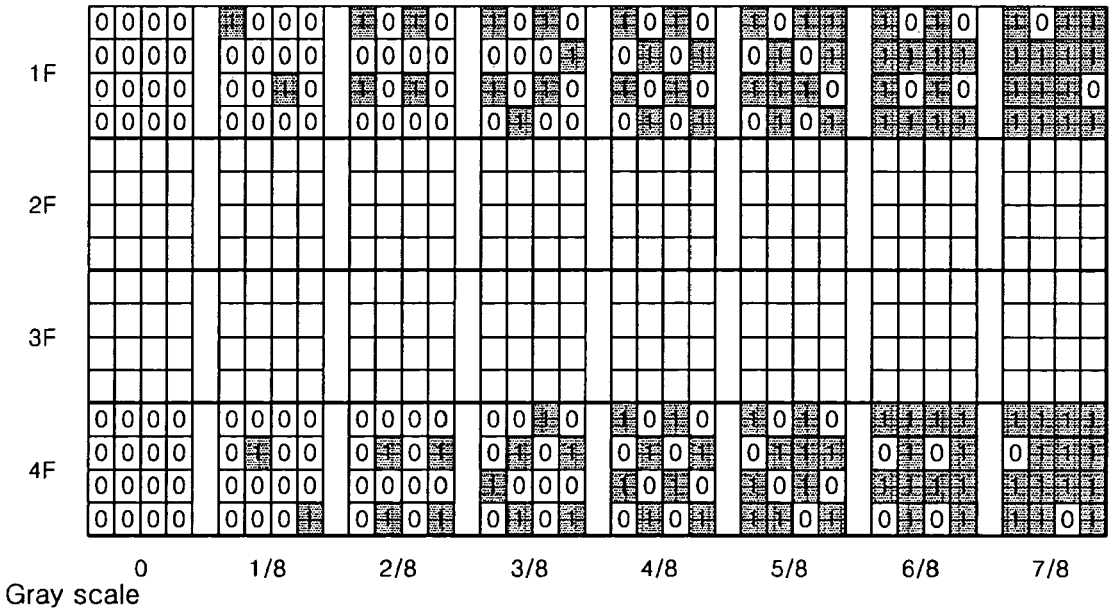
FIG. 8 illustrates dither mask patterns to which reference is made when dithering is performed by the dithering unit shown in FIG. 5.

The dithering unit 38 performs dithering by using the lower bits received from the adder 52. For example, if lower bits of received data are "011", the dithering unit 38 performs dithering by using a dither mask pattern corresponding to a 3/8 gray scale, among dither mask patterns as shown in FIG. 8. For instance, the dither mask patterns can be set to 0, 1/8, 2/8, /8, 4/8, 5/8, 6/8, 7/8 and 7/8 gray scales as shown in FIG. 8, and the number of cells a dither value of which is set to "1" in the dither mask patterns increases in order of 0, 2, 4, 6, 8, 10, 12 and 14 in number. Furthermore, it can be seen that locations of the cells the dither value of which is set to "1" are different every four frames 1F to 4F. In this time, the dither value "1" refers to that a cell is turned on, and the dither value "0" refers to that a cell is turned off.

Figure 9:
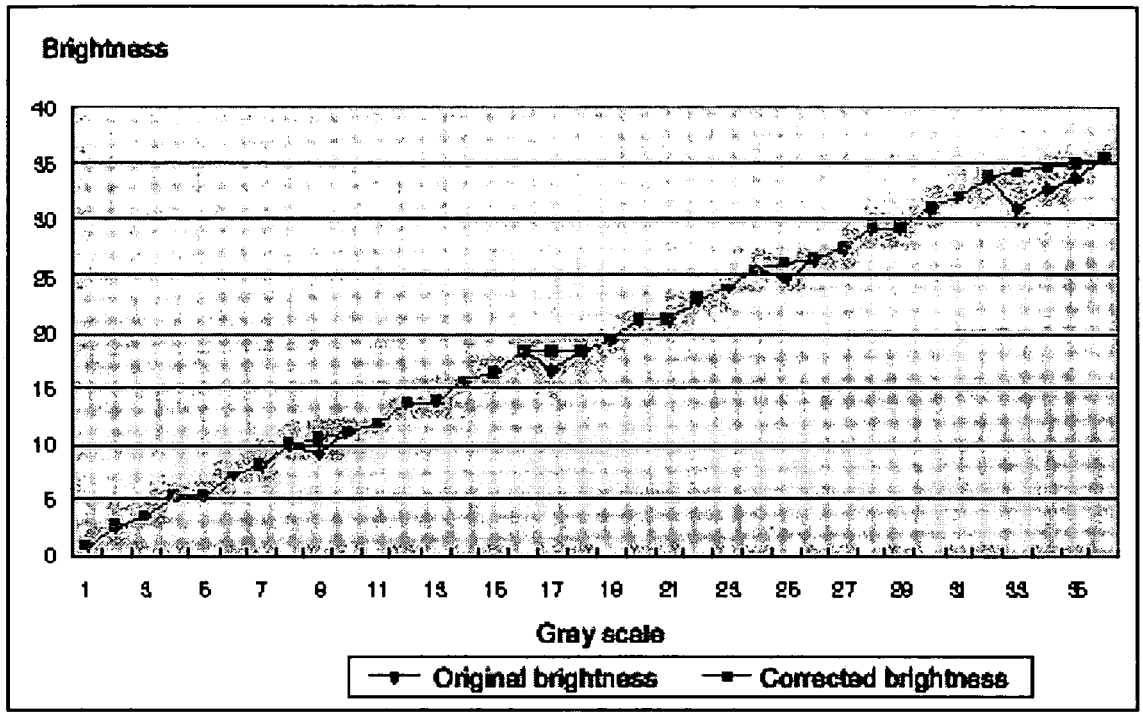
FIG. 9 is a graph showing gray scales represented according to the present invention.

The dithering unit 38 selects a dither mask pattern by using lower bits of data inputted thereto, and performs dithering by using the dither mask pattern (in this time, the higher the value of the lower bits, the higher the probability that the cell is turned on). In this time, the dithering unit 38 performs dithering by using lower bits to which 1 is added in gray scales where gray scale inversion is generated. That is, as cells that are turned on in dithering increase in probability, a gray scale inversion phenomenon can be prevented. In reality, if the present invention is applied, the gray scale inversion phenomenon is not generated, as shown in FIG. 9, and an image having linear brightness can be displayed accordingly.

As descried above, according to the apparatus and method for driving the PDP in accordance with the present invention, when dithering is performed on data where gray scale inversion is generated, a gray scale value can be improved by adding 1 to lowest bits of the data. It is thus possible to prevent the gray scale inversion phenomenon.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus for driving a plasma display panel, comprising:

an error diffusion unit for diffusing error of data received from an inverse gamma correction unit;

a gray scale inversion check unit connected to the inverse gamma correction unit, for checking whether a gray scale value of the data received from the inverse gamma correction unit is a gray scale value where a gray scale inversion phenomenon is generated, and generating a 1-bit control signal according to a result of the checking;

an adder disposed between the error diffusion unit and the gray scale inversion check unit, for adding the 1-bit control signal to lower bits of the data received from the error diffusion unit;

a compare unit for supplying lower bits received from the error diffusion unit to a dithering unit when the lower bits are all "1", and for supplying the lower bits to the adder when the lower bits are not all "1"; and the dithering unit for performing dithering by using the lower bits received from the adder.

2. The apparatus as claimed in claim 1, wherein the gray scale inversion check unit comprises a memory in which gray scale values where the gray scale inversion phenomenon is generated are previously stored.

3. The apparatus as claimed in claim 1, wherein the gray scale inversion check unit generates the 1-bit control signal of "1" when data having a gray scale value where the gray scale inversion phenomenon is generated is received, and generates the 1-bit control signal of "0" when data having a gray scale value where the gray scale inversion phenomenon is not generated is received.

4. An apparatus for driving a plasma display panel, comprising:

an error diffusion unit to diffuse error of data received from an inverse gamma correction unit;

a gray scale inversion check unit, coupled to the inverse gamma correction unit, to determine whether a gray scale value of the data received from the inverse gamma correction unit is a gray scale value in which a gray scale inversion phenomenon occurs, and to provide a control signal according to the determination;

an adder, between the error diffusion unit and the gray scale inversion check unit, to add the control signal to lower bits of the data received from the error diffusion unit;

a compare unit to supply lower bits received from the error diffusion unit to a dithering unit when the lower bits are all "1", and to supply the lower bits to the adder when the lower bits are not all "1"; and the dithering unit to perform dithering based on the lower bits received from the adder.

5. The apparatus as claimed in claim 4, wherein the control signal comprises a 1-bit control signal.

6. The apparatus as claimed in claim 4, wherein the gray scale inversion check unit comprises a memory in which gray scale values where the gray scale inversion phenomenon occurs are previously stored.

7. The apparatus as claimed in claim 4, wherein the gray scale inversion check unit provides the control signal of "1" when data having a gray scale value where the gray scale inversion phenomenon occurs is received, and provides the control signal of "0" when data having a gray scale value where the gray scale inversion phenomenon does not occur is received.

* * * * *